US005497148A

United States Patent [19]

Oliva

[11] Patent Number: 5,497,148

[45] Date of Patent: Mar. 5, 1996

[54] TRAFFIC INFORMATION WARNING SYSTEM

[75] Inventor: David C. Oliva, Chicago, Ill.

[73] Assignee: Cobra Electronics Corporation, Chicago, Ill.

[21] Appl. No.: 297,969

[22] Filed: Aug. 30, 1994

[51] Int. Cl.[6] ..... G08G 1/09

[52] U.S. Cl. ..... 340/905; 340/902; 340/903; 340/904; 340/906; 455/34.1; 455/34.2; 455/59

[58] Field of Search ..... 340/902, 903, 340/904, 905, 906; 455/34.1, 34.2, 59

[56] References Cited

U.S. PATENT DOCUMENTS

| | | | |
|---|---|---|---|
| 3,673,560 | 6/1972 | Barsh et al. | 340/33 |
| 3,772,641 | 11/1973 | Grosser et al. | 340/33 |
| 3,784,970 | 1/1974 | Simpkin | 340/33 |
| 4,216,545 | 8/1980 | Flickshu et al. | 455/77 |
| 4,443,790 | 4/1984 | Bishop | 340/902 |
| 4,794,394 | 12/1988 | Halstead | 340/902 |
| 5,091,906 | 2/1992 | Reed et al. | 370/94.1 |
| 5,235,329 | 8/1993 | Jackson | 340/902 |
| 5,307,060 | 4/1994 | Prevulsky et al. | 340/902 |

*Primary Examiner*—Brent A. Swarthout
*Assistant Examiner*—Daryl C. Pope
*Attorney, Agent, or Firm*—Wallenstein & Wagner, Ltd.

[57] ABSTRACT

A traffic information warning system for conveying traffic information from a traffic advisory site to a vehicle is disclosed. The traffic warning site comprises an emergency vehicle, a roadside hazard, or the like. The system comprises a transmitter adapted for placement at the advisory site and a receiver adapted for placement at the vehicle. The transmitter includes a first oscillator for transmitting a first unmodulated carrier signal at a first frequency and a second oscillator for transmitting a second unmodulated carrier signal at a second frequency. The first and second frequencies define the traffic information. The receiver includes a detector for detecting the first and second signals and an announcing device for announcing the traffic information.

10 Claims, 1 Drawing Sheet

TRAFFIC INFORMATION WARNING SYSTEM

DESCRIPTION

1. Technical Field

Applicant's invention relates to a vehicular traffic information system which warns, or otherwise advises, motorists of various traffic hazards and conditions in their particular operating vicinity.

2. Background Prior Art

Various systems have been proposed to inform motorists of traffic hazards.

Jackson, U.S. Pat. No. 5,235,329, is directed to a fleet of emergency vehicles, and to a system for permitting each of the emergency vehicles to warn each other, as well as warn other vehicles in the vicinity, of their presence.

Barsh, et. al., U.S. Pat. No. 3,673,560, similarly discloses a system for alerting persons in vehicles of the presence of emergency vehicles. According to this system, each emergency vehicle has a transmitter and a receiver. Each transmitter has an encoder which produces a signal having a duty cycle comprising a series of 15 kHz pulses for a period of approximately 0.5 sec., followed by a period of no pulses for approximately one second. This signal is transmitted at a modulated frequency of 150 MHz. Each receiver has a detector which is deactivated during the transmission of the 15 kHz signals, so as not to detect transmission of its own signal.

Grosser et al., U.S. Pat. No. 3,772,641, discloses a self-testing emergency automotive warning system for an emergency vehicle to warn drivers of nearby vehicles. The emergency signal is at 10 mHz, and use of the system in conjunction with stationary situations, such as unsafe bridges, tunnels, road construction, etc., is also disclosed.

Bishop, U.S. Pat. No. 4,443,790 discloses an alarm for an emergency vehicle which transmits a broadcast band carrier wave which has been modulated with a siren signal and voice signal. The carrier frequency is swept over both an AM and FM broadcast band for detection of conventional radio receivers.

Halstead, U.S. Pat. No. 4,794,394, discloses an emergency vehicle proximity warning system. An emergency vehicle transmits a continuous series of pulses. A second vehicle has a receiver which receives the pulses. Upon detection of the pulses, the receiver interrupts the connection between the radio and speaker of the second vehicle, and energizes lamps and/or sound-issuing devices within the second vehicle.

Each of these systems utilize modulated carrier signals to convey information, which are relatively complex and result in undesirable sideband signals. The present invention is provided to solve these and other problems.

SUMMARY OF THE INVENTION

It is an object of the invention to provide a traffic information warning system for conveying traffic information from a traffic advisory site to a vehicle. The traffic warning site comprises an emergency vehicle, a roadside hazard, or the like.

In accordance with the invention, the system comprises a transmitter adapted for placement at the advisory site and a receiver adapted for placement in the vehicle.

The transmitter includes means for transmitting a first unmodulated carrier signal at a first frequency and means for transmitting a second unmodulated carrier signal at a second frequency. The first and second frequencies define the traffic information.

The receiver includes means for detecting the first and second signals, means responsive to the detecting means for determining the traffic information and means responsive to the determining means for announcing the traffic information.

It is contemplated that the announcing means includes a visual display, an audible, or both.

In one embodiment, the receiver determines the traffic information by determining the magnitude of the frequency difference between the first and second frequencies.

In another embodiment, the receiver determines the traffic information by determining the specific frequency locations of the first and second frequencies.

It is further contemplated that the transmitter can include means for selectively transmitting one of a plurality of second unmodulated carrier signals, to selective transmission of a plurality of traffic information messages.

Other features and advantages of the invention will be apparent from the following specification taken in conjunction with the following drawing.

DETAILED DESCRIPTION

Figure 1:
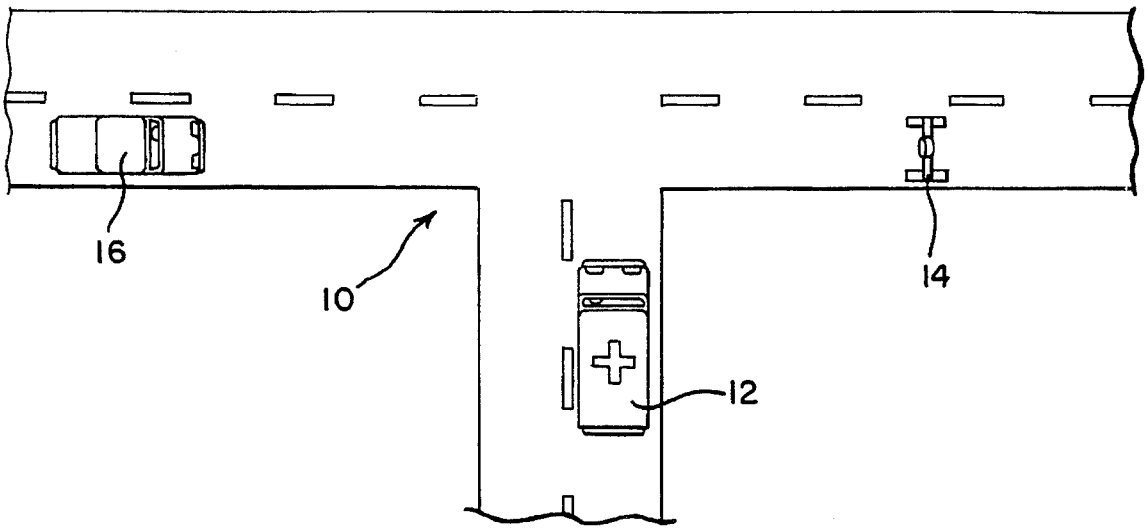
FIG. 1 is a schematic plan view of a traffic situation.

While this invention is susceptible of embodiments in many different forms, there is shown in the drawings and will herein be described in detail, preferred embodiments of the invention with the understanding that the present disclosure is to be considered as an exemplification of the principles of the invention and is not intended to limit the broad aspects of the invention to the embodiments illustrated.

Figure 2:
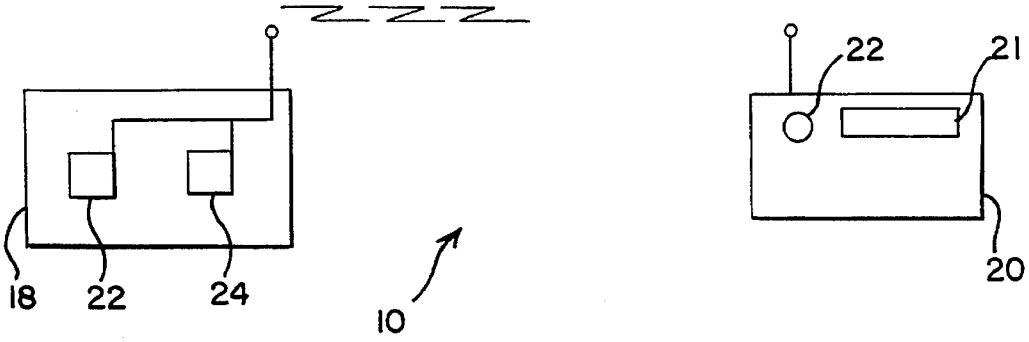
FIG. 2 is a block diagram of a transmitter and a receiver of a traffic hazard warning system in accordance with the invention.
Figure 3:
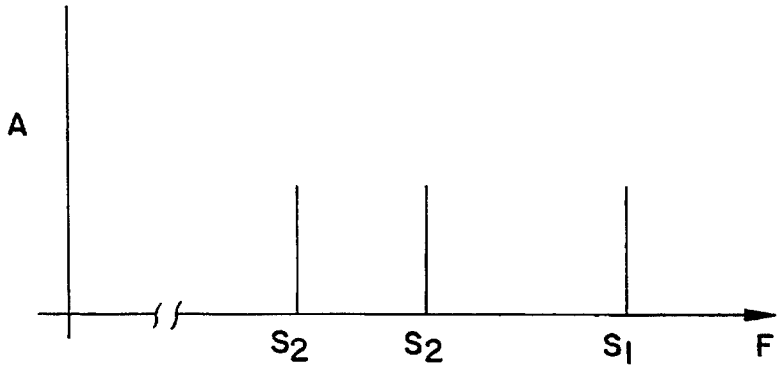
FIG. 3 is a graphic illustration of signals as used in accordance with the invention.

A traffic information warning system, generally designated 10, for conveying traffic information from a traffic advisory site, such as an emergency vehicle 12 or a roadside hazard 14, to a vehicle 16 is illustrated in FIG. 1. As shown in FIG. 2, the system 10 comprises a transmitter 18 adapted for placement at the advisory site, such as inside the emergency vehicle 12 or alongside the roadside hazard 14. The system 10 further comprises a receiver 20 adapted for placement inside the vehicle 16.

The transmitter 18 includes a first oscillator 22 for transmitting a first unmodulated carrier signal $s_1$ at a first frequency and a second oscillator 24 for transmitting a second unmodulated carrier signal at a second frequency $s_2$. The first and second frequencies $s_1$, $s_2$ together define the traffic information, although the invention contemplates various methods for encoding the information, discussed below.

The receiver 20 detects the first and second signals and responds to the detected signals to determine the traffic information. The receiver 20 then announces the traffic information. The announcement may be either via a visual display 21, such as a conventional LCD display, an audible display 22, or both. If an audible display, the message could be announced as a tone, which tone would have a prearranged and defined meaning for the operator of the vehicle. Alternatively, the audible message could be a stored voice message, as is well known.

For purposes of discussion, the first signal can be referred to as a reference signal. One such reference signal contemplated is 24.230 GHz., which is in the K-band. The second signal would be one of various other signal frequencies, depending upon the particular traffic information. It is contemplated that if the hazard is an emergency vehicle, the second signal frequency would be 24.11 GHz. It is further contemplated that if the hazard is a roadside hazard, the second signal frequency would be 24.07 GHz. In the event the hazard is a railroad, the reference signal frequency is contemplated to be 24.19 GHz and the second signal frequency would be 24.11 GHz. It should be apparent that any particular frequency could be utilized without departing from the scope of the invention.

Two receiver modes are contemplated for decoding the signal. According to the first mode, the receiver detects the magnitude of the frequency difference between the first and second frequencies. For example the receiver could include scanning circuitry to scan across the frequencies of interest, and the receiver "looks" for two signals separated by a predetermined frequency difference. For example, the magnitude of the difference between the reference signal and the roadside hazard signal is 160 MHz. Thus if the receiver detects two signals spaced by 160 MHz, it determines this to represent a roadside hazard, and alarms accordingly. As is well known, the difference can be determined by utilizing a receiver with a constant sweep rate, and measuring the time between the two frequency detections.

According to the second mode, the receiver 20 looks for the presence of signals located at specific frequency locations. With the above example, the receiver 20 would specifically look for one signal at 24.230 GHz and another signal at 24.07 GHz.

The receiver 20 could also be used to detect conventional police radar signals. However, because of its significant function to detect and warn of traffic hazards, the receiver 20 ignores police radar signals in the event traffic hazard signals are detected.

It is further contemplated that a single receiver could operate to detect and distinguish any of the various signals, such that a single receiver could warn the operator of a vehicle of any of the traffic hazards, or of such other information as the situation warrants.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A traffic information warning system for conveying a message of traffic information from a traffic advisory site to a vehicle, the system comprising a transimitter adapted for placement at said advisory site and a receiver adapted for placement at said vehicle, wherein:

said transmitter includes means for transmitting a first unmodulated carrier signal at a first discrete frequency and means for transmitting a second unmodulated carrier signal at a second discrete frequency, wherein said first and second frequencies are each located at a frequency location and said message is specified by the specific frequency locations of said first and second discrete frequencies; and said receiver includes means for detecting said first and second signals, means responsive to said detecting means for determining said message of said traffic information and means responsive to said determining means for announcing said message of said traffic information.

2. The traffic information warning system of claim 1 wherein said announcing means includes a visual display.

3. The traffic information warning system of claim 1 wherein said announcing means includes an audible sound.

4. The traffic information warning system of claim 1 wherein said receiver includes means for sweeping across a range of frequencies including said first and second frequencies to determine a time period between detection of the first and second signals, such that said time period corresponds to the difference between said first and second frequencies.

5. The traffic information warning system of claim 1 wherein said traffic advisory site comprises an emergency vehicle.

6. The traffic information warning system of claim 1 wherein said traffic advisory site comprises a roadside hazard.

7. A traffic information warning system for conveying a plurality of messages of traffic information from a traffic advisory site to a vehicle, the system comprising a transmitter adapted for placement at said advisory site and a receiver adapted for placement at said vehicle, wherein:

said transmitter includes means for transmitting an unmodulated carrier reference signal at a first discrete frequency location and means for transmitting one of a plurality of second unmodulated carrier signals at one of a plurality of second discrete frequency locations, wherein a respective combination of the first frequency location and each of the second frequency locations specifies a particular one of said messages of traffic information; and said receiver includes means for detecting said first signal and said second, selected signal, means responsive to said detecting means for determining said message of said traffic information and means responsive to said determining means for announcing said message of said traffic information.

8. A traffic information warning system for conveying traffic information from a traffic advisory site to a vehicle, the system comprising a transmitter adapted for placement at said advisory site and a receiver adapted for placement at said vehicle, wherein:

said transmitter includes means for transmitting a plurality of unmodulated carrier signals at a respective plurality of discrete frequencies, wherein the plurality of discrete frequencies define said traffic information; and said receiver includes means for detecting said plurality of discrete frequencies, means responsive to said detecting means for determining said traffic information and means responsive to said determining means for announcing said traffic information.

9. A traffic information warning system for conveying a message of traffic information from a traffic advisory site to vehicle, the system comprising a transmitter adapted for placement at said advisory site and a receiver adapted for placement at said vehicle, wherein:

said transmitter includes means for transmitting a first unmodulated carrier signal at a first frequency and means for transmitting a second unmodulated carrier signal at a second frequency, wherein said first and second frequencies are separated by a frequency difference, and said difference between said first and second frequencies specifies said message of said traffic information; and said receiver includes means for detecting said first and second signals, means responsive to said detecting means for determining said traffic information and means responsive to said determining means for announcing said message of said traffic information.

10. The traffic information warning system of claim 9 wherein said receiver includes means for sweeping across a range of frequencies including said first and second frequencies to determine a time period between detection of the first and second signals, such that said time period corresponds to the difference between said first and second frequencies.

* * * * *